United States Patent [19]

Hunter

[11] Patent Number: 4,930,174

[45] Date of Patent: Jun. 5, 1990

[54] PUMP ASSEMBLY FOR AIR MATTRESS

[75] Inventor: Murray Hunter, Balmain, Australia

[73] Assignee: Jackel International Pty. Ltd., Rydalmere, Australia

[21] Appl. No.: 206,745

[22] Filed: Jun. 15, 1988

[30] Foreign Application Priority Data

Jun. 16, 1987 [AU] Australia ..... PI2508

[51] Int. Cl.[5] ..... A47C 27/08; F04B 43/00

[52] U.S. Cl. ..... 5/454; 417/479

[58] Field of Search ..... 5/454, 453, 449; 441/41; 297/DIG. 3; 251/304; 137/223, 625.31; 417/479, 480

[56] References Cited

U.S. PATENT DOCUMENTS

| | | | |
|---|---|---|---|
| 2,772,692 | 12/1956 | Russell | 137/223 |
| 3,042,941 | 7/1962 | Marcus | 5/454 |
| 3,068,494 | 12/1962 | Pinkwater | 5/454 |
| 3,112,502 | 12/1963 | Forsberg | 5/454 |
| 3,133,696 | 5/1964 | Mirando | 5/454 |
| 3,155,991 | 11/1964 | Dunham | 5/454 |
| 3,995,653 | 12/1976 | Mackal et al. | 137/223 |
| 4,015,622 | 4/1977 | Pagani | 137/223 |
| 4,694,515 | 9/1987 | Rogers, Jr. | 137/223 |

*Primary Examiner*—Alexander Grosz

*Attorney, Agent, or Firm*—Cushman, Darby & Cushman

[57] ABSTRACT

An air mattress incorporating within it a pump having a variable volume chamber formed by a flexible sheeting material, located within the chamber is a block of foam material which biases the chamber to its maximum volume, an air outlet incorporating a one way valve restricts air to move outwardly from within the chamber, while an air inlet is maintained clear during a pumping operation and is selectively closed by the hand of the operator.

8 Claims, 6 Drawing Sheets

PUMP ASSEMBLY FOR AIR MATTRESS

The present invention relates to inflatable articles such as toys and air mattresses.

Inflatable articles such as inflatable toys and air beds, have required the user to inflate the article either by exhaling into the article, or alternatively by using a pump which may be hand, foot or motor operated. However, where a pump is employed, the pump is a separate item to the inflatable article.

It is the disadvantage of the above discussed inflatable articles, that firstly if a pump is not used, then the user must inflate the article by exhaling into the article. This will often cause discomfort, and is generally time consuming. Where a separate pump is provided, the overall cost of using the inflatable article is considerably increased. Still further, these pumps require separate storage and therefor are not convenient if for example the air mattress is being transported in a "back pack".

Attempts have been made to overcome the problems of providing a separate pump. For example, there is disclosed in U.S. Pat. Nos. 3.068,494; 3,112,502; 3,155,991; air mattresses with the pumps formed integral therewith. Still further, there is disclosed in U.S. Pat. No. 3,133,696 an air bed with the pump formed integral therewith, with the pump being provided with a variable volume chamber, biased to its maximum volume by means of a porous foam block.

The devices disclosed in the above U.S. patents all require the air intake for the pump to include a one way valve assembly. These valve assemblies considerably restrict air flow into the pump and accordingly the pumps are generally slow to operate. Still further, as the valves wear they leak further lengthening the time required to inflate the air mattress. Still further, only a single pump assembly is provided again exacerbating the problems in respect of the time required to inflate the air mattress.

It is the object of the present invention to overcome or substantially ameliorate the above disadvantages.

There is disclosed herein a pump assembly comprising an envelope of generally flexible sheet material enclosing a chamber which may be varied in volume, a porous foam material located in said chamber so as to bias said envelope to occupy a configuration maximising said volume, first duct means extending from said chamber, and incorporating a one way valve to restrict the flow of fluid from said chamber to exhaust via said first duct means, and second duct means to allow fluid to be drawn into said chamber so that upon a user varying the volume of said chamber by compressing said foam, fluid is allowed to be drawn into said chamber and then exhausted through said first duct means upon compression of said foam, and wherein said second duct means remains clear during a pumping operation and is located relative to said foam material and said chamber so that the user upon applying a force to said chamber to cause compression of said foam material, by pressing a hand or foot thereagainst, said second duct is closed by the user's hand or foot thereby permitting a compressive force to be applied to the fluid within said chamber.

A preferred form of the present invention will now be described by way of example with reference to the accompanying drawings wherein.

Figure 1:
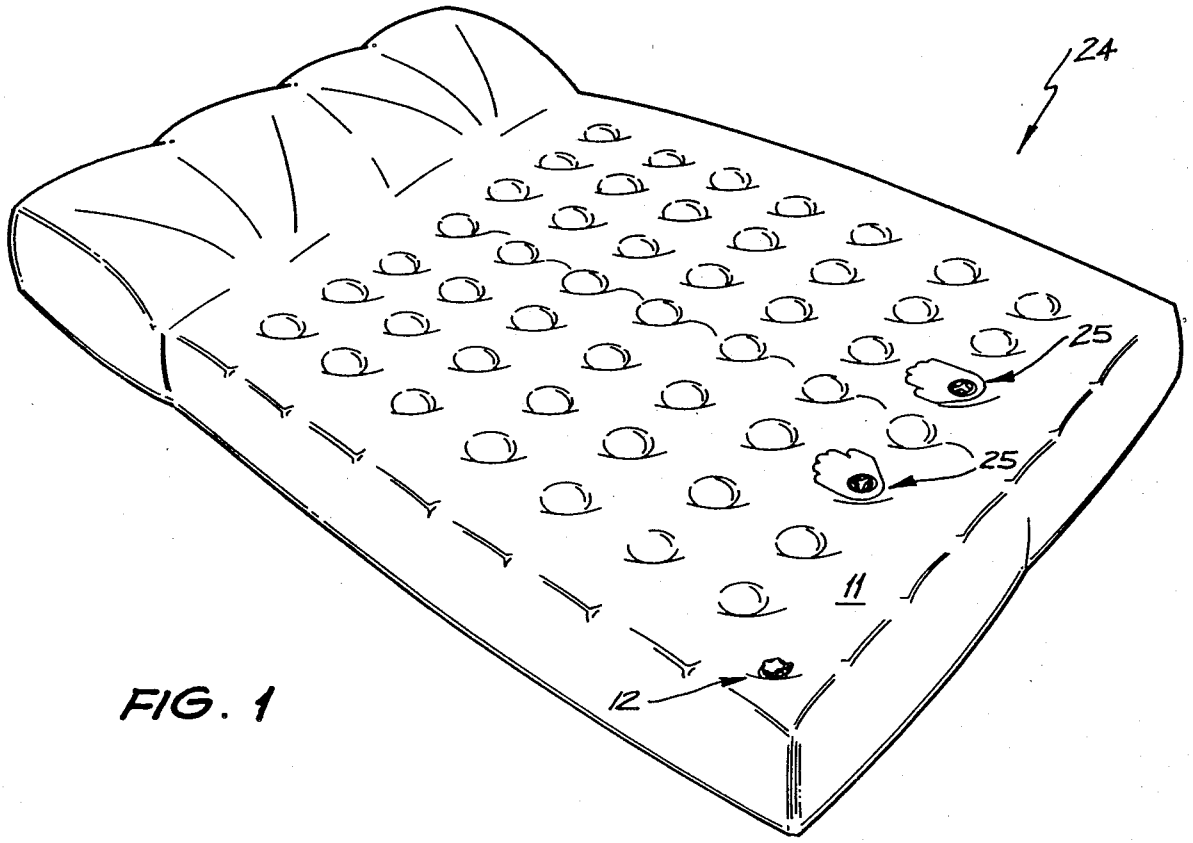
FIG. 1 is a schematic top perspective view of an air mattress.
Figure 2:
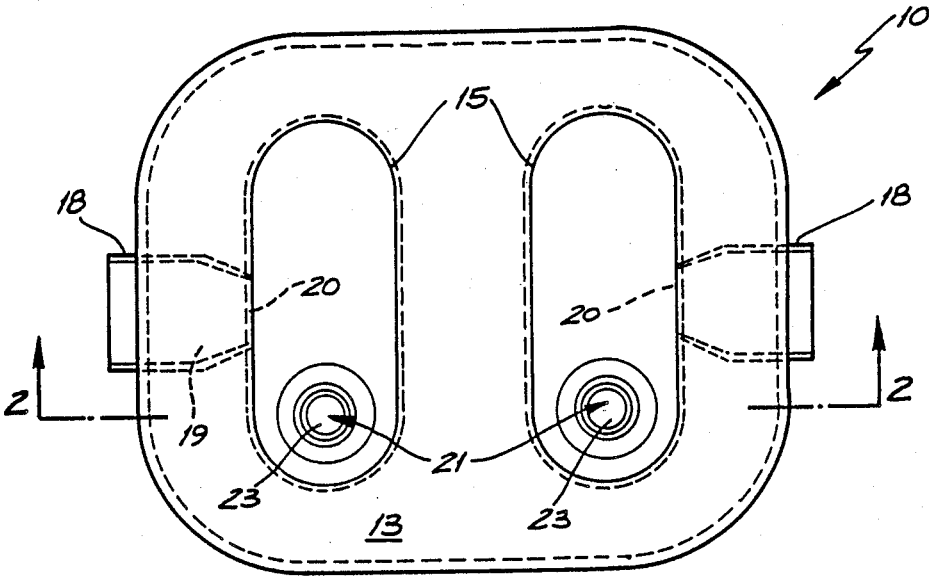
FIG. 2 is a schematic plan view of a pump assembly used in the air mattress of FIG. 1.
Figure 3:
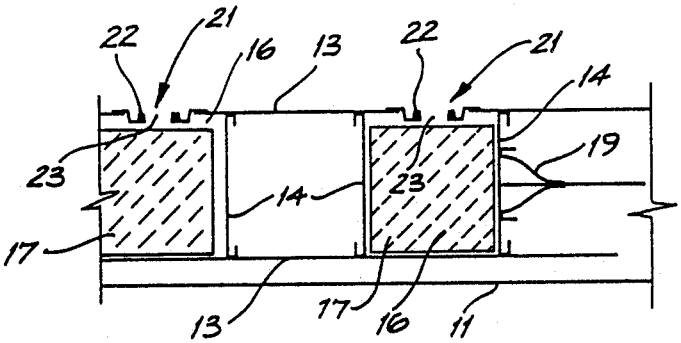
FIG. 3 is a schematic sectioned side elevation of the pump assembly of FIG. 2, sectioned along the line 2—2.
Figure 4:
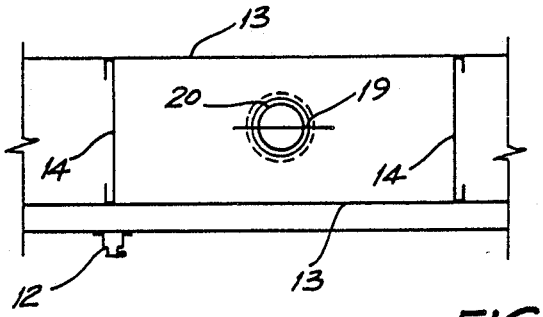
FIG. 4 is a schematic end elevation of a portion of the pump assembly of FIG. 2.
Figure 5:
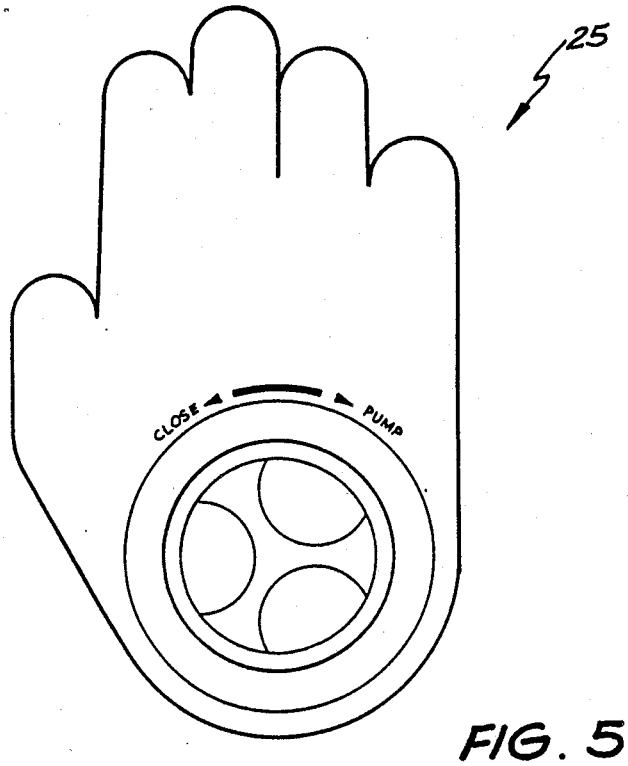
FIG. 5 is a schematic plan view of the air inlet of the pump assembly of FIG. 2.
Figure 6:
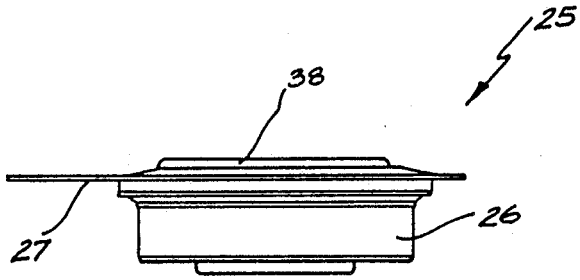
FIG. 6 is a schematic side elevation of the air inlet of FIG. 5.
Figure 7:
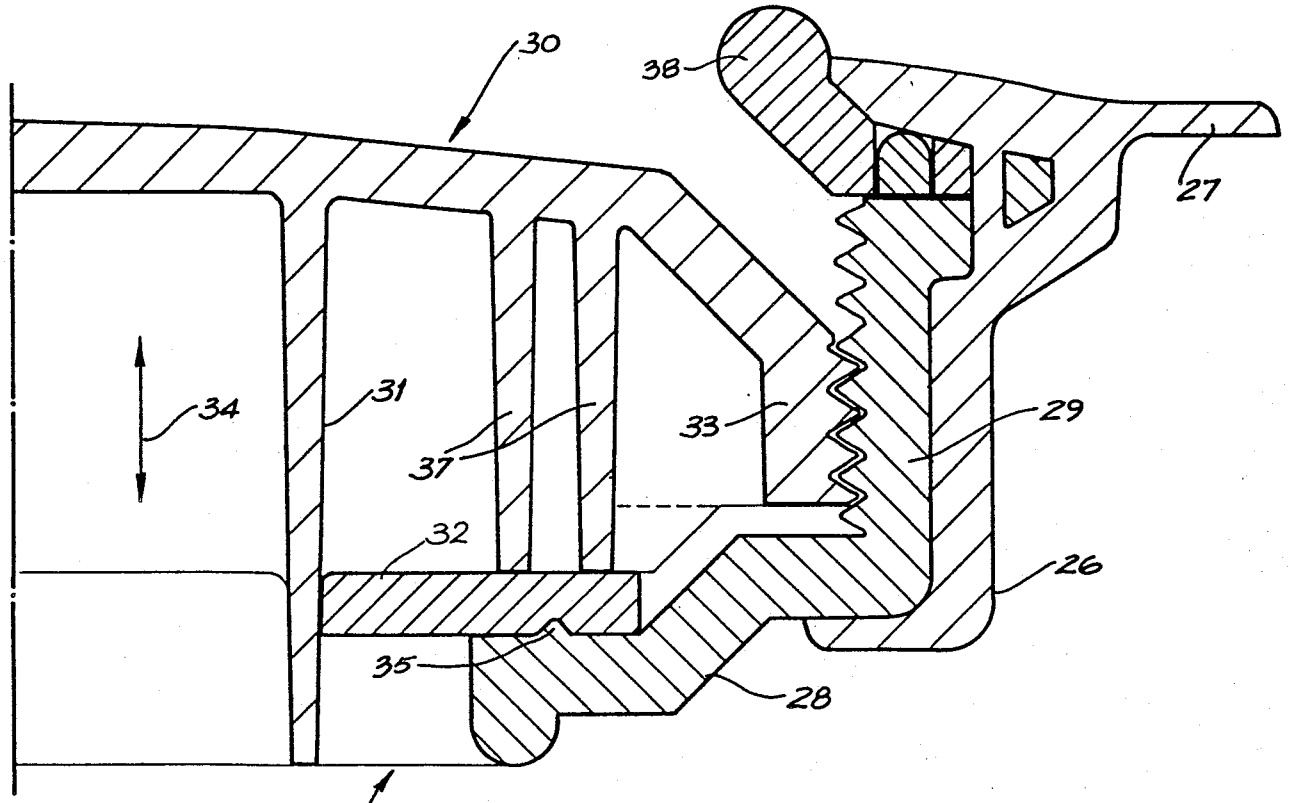
FIG. 7 is a schematic sectioned side elevation of a portion of the air inlet of FIG. 5.
Figure 8:
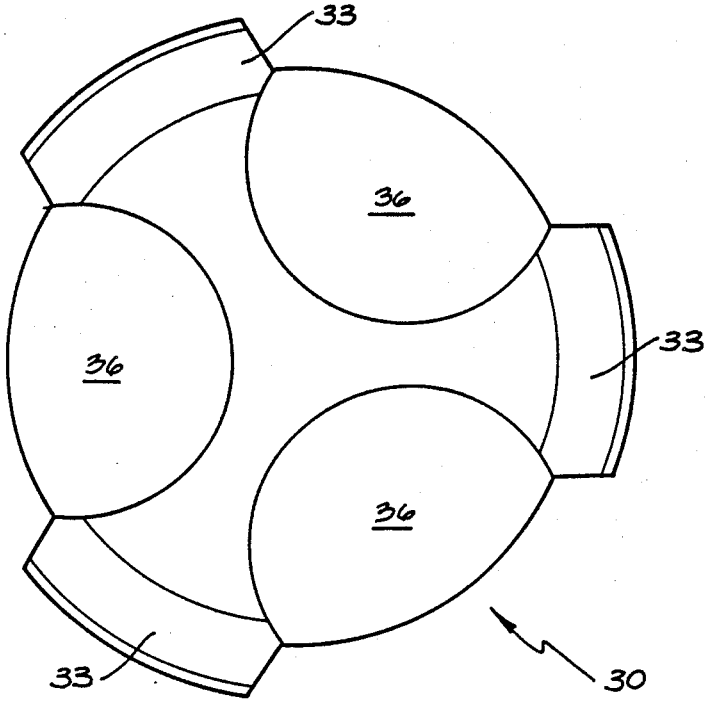
FIG. 8 is a schematic top plan view of the center portion of the air inlet of FIG. 5.
Figure 9:
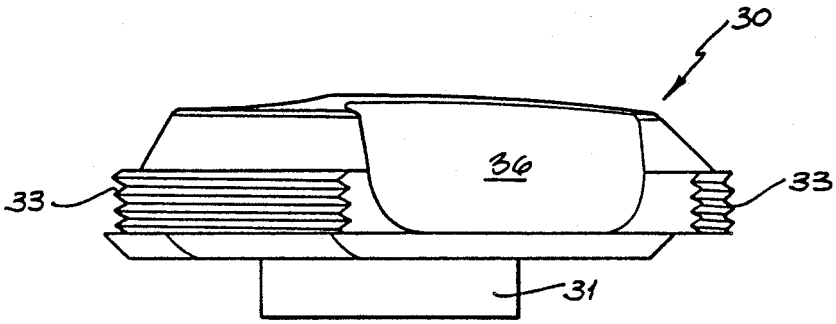
FIG. 9 is a scnematic side elevation of the center portion of FIG. 8

In the accompanying drawings there is schematically depicted a pump assembly 10 which may be incorporated within, or provided separately to, an inflatable object. More preferably, the pump 10 is adapted to be inserted in an air mattress 24 having an outer wall 11 provided with an exhaust valve 12.

The pump assembly 10 consists of a pair of sheet members 13 which are generally co-extensive. Extending between the sheet members 13 are internal walls 14. The members 13 and walls 14 are formed of flexible sheet material, such as polyvinylchloride, in which case the walls 14 would be welded or heat fused to the members 13.

The walls 14 co-operate with the members 13 to provide envelopes 15. The envelopes 15 define chambers 16 whose volumes may be varied. Located in each chamber 16 is a block 17 of porous foam material.

Extending from each envelope 15 is a first duct 18 which also acts as a one way valve. Each first duct 18 is formed of flexible material so that the walls 19 of the duct 18 act as a "reed valve". For example, the walls 19 could be formed of polyvinylchloride, and welded to the walls 14. The join 20 between the walls 14 and 19 could define a generally annular configuration.

One of the members 13 is also provided with second ducts 21 which are in the form of reinforced portions defining an annular ring 22 around the passages 23 providing the ducts 21.

In operation of the above discussed pump assembly 10, a user places a hand on the top of each envelope 15 so that the palm of each hand closes an associated passage 21. In the rest configuration, each chamber 16 defines a maximum volume. That is the foam blocks 17 bias the members 13 apart to provide the chamber 16 with the maximum volume. The user, then places a hand over each passage 23 and compresses the foam blocks 17. The foam blocks 17 may be compressed together, or out of phase. By compressing the blocks 17, the volume of the chamber 16 is reduced, thereby compressing the air within each chamber 16. The air is then forced out through the first ducts 18 into the air mattress. When the user releases a hand from one of the envelopes 15, the associated passage 23 is exposed thereby allowing air to enter the chamber 16 and the foam block 17 to expand thereby maximising the volume of the associated chamber 16. This process is repeated until the air mattress is inflated.

The air mattress 24 employs two pump assemblies 10 incorporated within it. Each pump assembly 10 has a second duct 21 providing the air inlet passage 23. In FIGS. 5 to 9 there is schematically depicted an air inlet assembly 25, two of which are employed with the air mattress 24 and provide the air intake for each pump assembly 10.

Each air intake assembly 25 includes a body 26 secured to the sheet material forming the outer wall 11 of the air mattress 24, via the flange 27. The body 26 receives a threaded insert 28 of annular configuration providing an annular upstanding wall 29 which is internally threaded. The insert 28 has a central opening providing the passage 23. The insert 28 threadably engages a center piece 30 which is rotable about a vertical axis. The center piece 30 has a central annular flange 31 which engages a sealing washer 32. The center piece 30 further has an outer annular wall 33 which is threaded and threadably engages the wall 29. Rotation of the center piece 30 about its longitudinal axis will cause movement of the center piece 30 in the direction of the arrow 34 depending on the direction of rotation, due to the threaded engagement between the wall 29 and the wall 33. The insert 28 further has a circular sealing lip 35 which is engaged by the washer 32 to sealingly close the passage 23 by sealingly connecting the center piece 30 with the insert 28. The washer 32 is pressed against the sealing lip 35 by a pair of cylindrical walls 37.

The center piece 30 has cutaway portions 36 which allow air to be ducted to the passage 23 when the washer 32 is moved from sealing contact with the sealing lip 35 by rotation of the center piece 30.

Fixed to the body 26 is a ring member 38 which is engaged by the hand of the operator of the pump.

Figure 10:
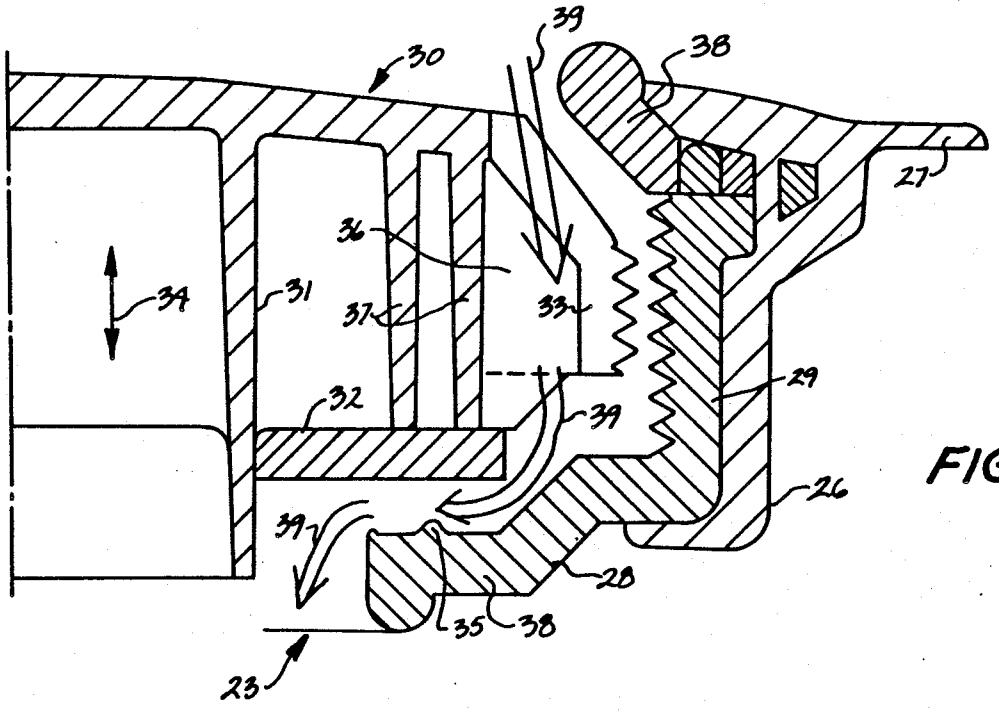
FIG. 10 is a schematic sectioned side elevation of a portion of FIG. 7, with the air inlet open.

In use of the air inlet assembly 25, the user rotates the centre piece in the direction of the arrow labelled "pump" to open the passage 23 to allow air to enter the passage 23 via the cutaway portions 36, as shown in FIG. 10. Thereafter the operator presses their hand against the ring member 38 to sealingly close the air inlet assembly 24 and to apply a compression force to the foam block 17 and thereby reduce the volume of the chamber 16. Once the operator removes the hand the air intake assembly 25 is open. Air then passes through the pump assembly 10 in the direction of the arrows 39. This is repeated until the air mattress 24 is inflated. The passage 23 is then effectively closed by rotation of the center piece 30 in the direction of the arrow levelled "close" so that the sealing washer 32 is moved into sealing contact with the sealing lip 35.

What I claim is:

1. A fluid pump assembly comprising:

an envelope of generally flexible sheet material enclosing a chamber which can be varied in volume;

resilient means located in said chamber so as to bias said envelope to occupy a configuration maximizing said volume, said volume being reducible by the pressure of the hand or foot of an operator at an optimum location on the exterior of said envelope;

outlet duct means extending from said chamber;

a one-way valve in said outlet duct means to restrict the flow of fluid through said outlet means from said chamber to exhaust to the exterior of said chamber; and inlet duct means extending into said chamber to allow fluid to be drawn into said chamber from the exterior thereof, said inlet duct means being substantially unobstructed to the flow of air therethrough into said chamber during a pumping operation and having an unobstructed inlet opening on the exterior of said chamber constructed and arranged to be closed by the hand or foot of an operator during an application of pressure at said optimum location on the exterior of said envelope, whereby on application of such pressure, fluid in said chamber is compressed and forced to exhaust to the exterior of said envelope through said outlet duct means and said one-way valve and on relief of such pressure by the lifting of the hand or foot of the operator, said inlet opening is opened, the volume of said chamber expands and air is drawn substantially unobstructedly into said chamber through said inlet duct means.

2. The pump assembly of claim 1 wherein said inlet duct means comprises an air intake assembly including a generally annular body surrounding said inlet duct means, a center piece mounted within said body and rotatably movable between an open position allowing air to enter said inlet duct means, and a closed position closing said inlet duct means.

3. An air mattress incorporating at least one pump assembly according to claim 1.

4. An air mattress comprising:

a flexible hollow body formed of sheet material and enclosing a space to receive air under pressure, said body having a major horizontal upper surface and a major horizontal lower surface joined by side surfaces; and a fluid pump assembly contained within said body and comprising:

an envelope of generally flexible sheet material enclosing a pump chamber which can be varied in volume and having an exterior surface adjacent said body upper surface;

resilient means located in said chamber so as to bias said envelope to occupy a configuration maximizing said volume, said volume being reducible by the pressure of the hand or foot of an operator on a portion of said body upper surface opposed to an optimum location on said exterior surface of said envelope;

outlet duct means extending from said chamber to said body space;

a one-way valve in said outlet duct means to restrict the flow of fluid through said outlet means from said chamber to exhaust into said body space; and inlet duct means extending through said body upper surface into said chamber to allow fluid to be drawn into said chamber from the exterior of said mattress, said inlet duct means being substantially unobstructed to the flow of air therethrough into said chamber during a pumping operation and having an unobstructed inlet opening on said body upper surface constructed and arranged to be closed by the hand or foot of an operator during an application of pressure on said body upper surface portion, whereby on application of such pressure, fluid in said chamber is compressed and forced to exhaust into said body space through said outlet duct means and said one-way valve and on relief of such pressure, by the lifting of the hand or foot, of the operator said inlet opening is opened, a volume of said chamber expands and air is drawn substantially unobstructedly into said chamber through said inlet duct means.

5. The air mattress of claim 4, wherein said air inlet opening is provided by a generally annular body surrounding an exterior end portion of said inlet duct means, and a centerpiece mounted within said annular body and rotatably movable between an open position allowing air to enter said inlet duct means, and a closed position closing said inlet duct means.

6. The air mattress of claim 5, wherein said pump assembly includes an annular sealing washer, which is sandwiched between said annular body and said centerpiece to close said inlet duct means.

7. The air mattress of claim 6, wherein said annular body includes an annular sealing lip, and said centerpiece includes an annular flange upon which said washer is mounted, and a cylindrical wall which engages the washer to sandwich the washer against said annular sealing lip to close said opening.

8. The air mattress of claim 7, wherein said outlet and inlet duct means are formed of flexible material.

* * * * *